United States Patent [19]

D'Alessandro et al.

[11] 4,045,890

[45] Sept. 6, 1977

[54] SKI BOOT CLEAT

[76] Inventors: John A. D'Alessandro, 9236 Appleby St.; Lawrence A. Tuohino, 9331 Gallatin Road, both of Downey, Calif. 90240

[21] Appl. No.: 713,633

[22] Filed: Aug. 18, 1976

[51] Int. Cl.[2] ..... A43B 5/00; A43D 5/00

[52] U.S. Cl. ..... 36/132; 12/120.5

[58] Field of Search ..... 36/117, 118, 119, 120, 36/121, 132, 134; 12/120.5

[56] References Cited

U.S. PATENT DOCUMENTS

| | | | |
|---|---|---|---|
| 3,665,620 | 5/1972 | St. Clair | 36/138 |
| 3,971,144 | 7/1976 | Brugger-Stuker | 36/117 |

FOREIGN PATENT DOCUMENTS

| | | | |
|---|---|---|---|
| 2,363,131 | 6/1975 | Germany | 36/132 |
| 2,314,847 | 10/1974 | Germany | 36/132 |

*Primary Examiner*—Patrick D. Lawson

[57] ABSTRACT

A ski-boot cleat which is adapted to be removably attached to the well known ski boot whereby the skier can stand erect in a substantially vertical position when the cleat is positioned under the ball of the foot. The cleat comprises a main cleat body having the bottom surface formed with a plurality of transverse rib members, whereby the boot can fulcrum thereon, the upper surface being formed with a recess having longitudinal flange members located on the opposite sides of the recess wherein the sole of the boot is received therein. The cleat includes a resilient strap secured thereto, the strap being arranged to be mounted over the outer peripheral edge of the sole.

5 Claims, 5 Drawing Figures

10
26b
36
24
22
2
12
48
46
24
32
45
26a
26
32
2

10

26
12
26
28
30
30
32

18
14
16
33
24
12
26
36
34
35
10
32
20

18
14
12
10
45
46
16
26b
44
48
42
20
40

18
14
16
36
33
24
26
34
12
20
10
32

40
42

SKI BOOT CLEAT

BACKGROUND OF THE INVENTION

1. Field of the Invention

This invention relates to ski boots and, more particularly, to a cleat which is arranged to be removably mounted to a ski boot when the boot is not mounted to a ski, allowing the skier to stand substantially erect.

2. Description of the Prior Art

As is well known in the art, various problems and difficulties are encontered when a skier tries to stand for long periods of time or walks when wearing ski boots, particularly when the ground surface is substantially flat.

There are many types of ski boots that are available for use by skiers; however, the average ski boot is made of rather stiff material, some being molded as a monolithic unit. Thus, once the skier is wearing the shoes, he or she has a very difficult time standing in an erect position.

Due to the particular configuration of ski boots, the skier is generally compelled to have his knees bent forwardly when both standing and walking. That is, the portion of the boot that covers the ankle and lower leg area is formed at a slight angle leaning towards the toe of the shoe portion, and is not flexible. Therefore, the foot and ankle of the skier are held firmly at the angle of the particular boot.

It becomes very difficult to stand for any length of time or to walk for any distance under these conditions.

Hence, a suitable means that can be readily attachable to the ski boot, to cause the wearer thereof to stand in a more vertical position, is highly desirable.

The following description of the applicant's invention will show how the above problems have been overcome.

SUMMARY OF THE INVENTION

The present invention comprises a cleat for ski boots that is removably attached thereto to enable the wearer to stand in a more vertical position than is at present possible. The ski-boot cleat comprises a cleat body which is designed to fit across the sole of a ski boot, preferably adjacent the ball of the foot of the wearer thereof. The cleat body includes a channeled recess defined by oppositely disposed flange members, wherein the sole of the boot is received in a recess having the flanges positioned beside the outer edge of the sole.

The lower or bottom surface of the cleat is formed with a plurality of transverse rib members that define a fulcrum means, which will allow the wearer of the boot to transfer his weight back and forth from the heel to the toe, and vice versa, when walking. The cleat also allows the wearer, while standing, to transfer his body weight to the heel of the boot with the forward shoe portion being elevated, thereby allowing the knee of the skier to have a less geniculated arrangement. Thus, the skier can stand substantially erect in a more relaxed position.

Accordingly, in order to hold the cleat body in the proper position on the sole, there is included a flexible, stretchable strap which is secured to the cleat by being received in a pair of longitudinal slots formed in the cleat body. The strap is stretched to mount about the extended peripheral edge of the boot. Thus, it can be mounted or removed at any time to allow the ski to be mounted to the ski boot.

The present device has an additional feature wherein the strap can be positioned around the ankle area and indirectly attached to the ski by a snap clamp and connecting line. This provides a safety strap as well, whereby the ski can not be completely separated from the skier when the ski becomes disengaged from the boot, particularly during use.

OBJECTS AND ADVANTAGES OF THE INVENTION

The present invention has for an important object a provision wherein a skier is provided with more freedom of action in walking and/or standing in the ski boots, thereby preventing the necessity of the awkward position of knees-bent-forward that the present style of ski boots requires.

It is another object of the invention to provide a ski-boot cleat that is easily adjustable to fit all types and sizes of boots and shoes.

It is still another object of the invention to provide a ski-boot cleat that allows the wearer thereof to transfer his weight from heel to toe, or toe to heel, without too much effort, the cleat thus becoming a fulcrum point of the boot.

It is a further object of the invention to provide a second feature wherein the device can be used a safety connecting means between the skier and the ski.

It is still a further object of the invention to provide a device of this character that includes few operating parts.

Still another object of the invention is to provide a device of this character that is relatively inexpensive to manufacture.

A still further object of the present invention is to provide a ski-boot cleat that is simple but rugged in construction.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
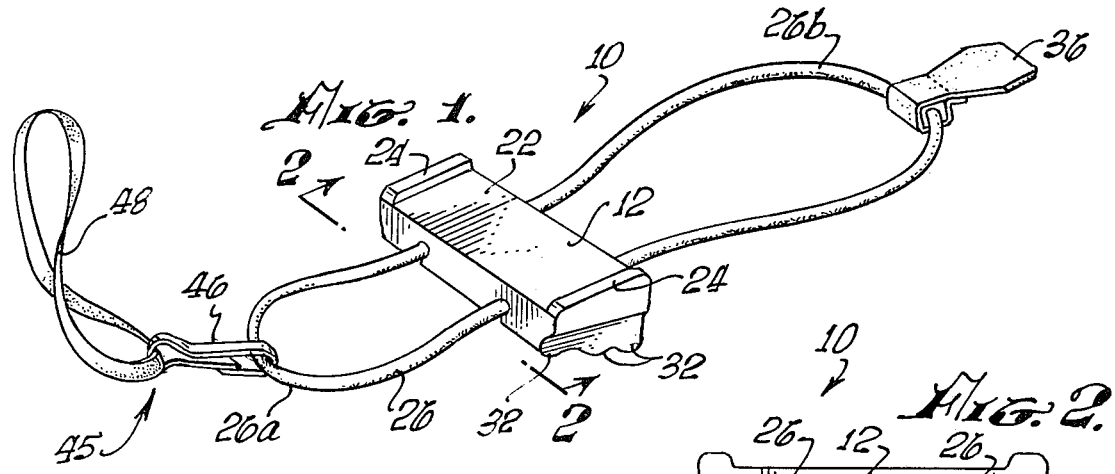
FIG. 1 is a perspective view of the present invention illustrating the safety connecting unit attached thereto.
Figure 3:
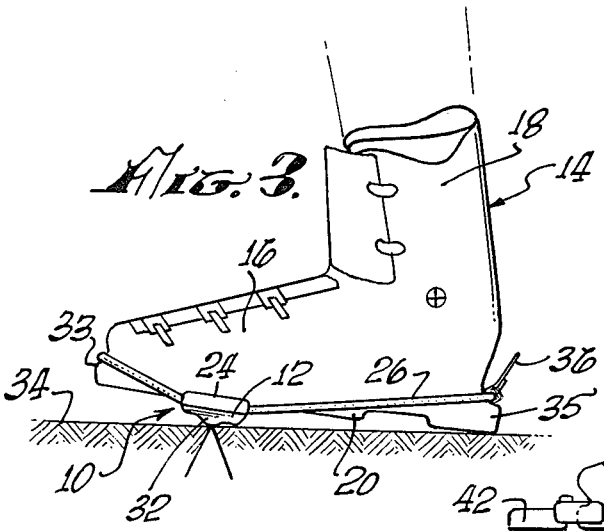
FIG. 3 is a side elevational view showing the ski cleat mounted to a ski boot when the body weight is placed on the heel.
Figure 4:
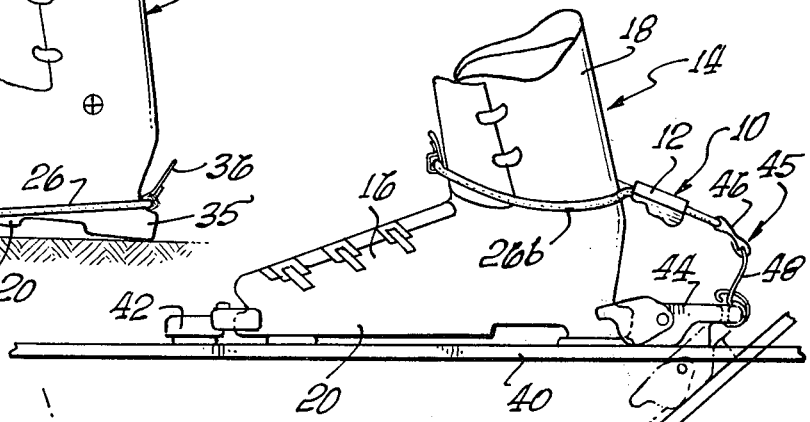
FIG. 4 is a side elevational view showing the ski cleat mounted to the ski boot when the body weight is placed on the forward or ball portion of the boot.
Figure 4:
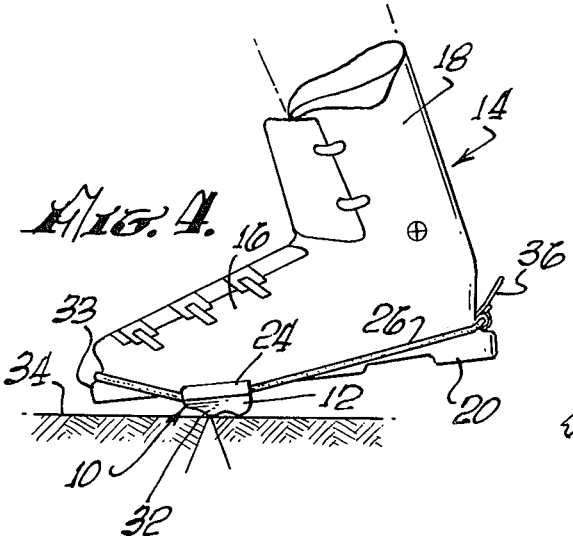
Figure 5:
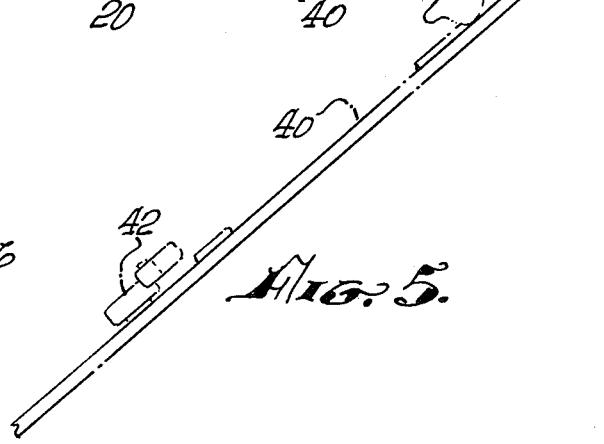
FIG. 5 illustrates the present invention being used as a safety connecting means attached between the boot and a ski.

Referring more particularly to the drawings, there is shown in FIG. 1 a ski-boot cleat, generally indicated at 10, comprising a cleat body 12 having a substantially rectangular configuration, wherein the overall length thereof is equal to the average width of the sole of most ski boots, the ski boot being indicated generally at 14 at FIGS. 3, 4 and 5.

Ski boots of the type shown are very often made of such materials that the boot is rather stiff and non-pliable. That is, the shoe portion 16 is generally integrally formed with the ankle portion 18 and the sole 20. To aid in the proper stance or posture of the ankle, portion 18 is very often inclined forwardly towards the toe of the shoe portion 16. Due to inclined arrangement of the ankle-shoe portion relationship and the non-flexible situation between each portion, the wearer thereof is forced to bend his knees forwardly, which is necessary when one is actually skiing. However, it becomes very awkward when the skies are no longer attached to the boots. That is, while the skier is standing and is not ready to ski, he is positioned with his knees slightly geniculated forwardly. Thus, in order to provide a more erect or vertical posture, one simply can attach the ski-boot cleat 10 as seen in FIGS. 3 and 4.

Accordingly, the cleat body 12 includes a transverse elongated recess 22 defined by oppositely disposed side flange members 24. The recess 22 is so arranged as to freely receive the sole 20 of the boot therein, wherein each flange member 24 is positioned adjacent the outer edges of sole 20, and wherein the cleat is located adjacent and below the ball of the foot.

Figure 2:
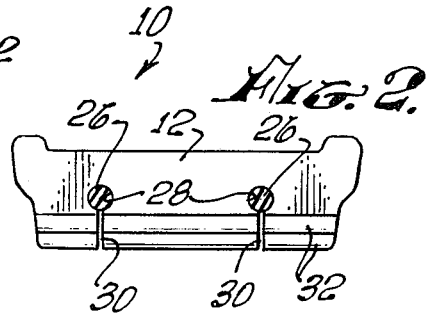
FIG. 2 is a cross-sectional view taken along line 2—2 of FIG. 1 showing the mounting strap secured to the cleat body.

The cleat body 12 is slidably attached to a mounting strap 26 formed as a continuous loop of a flexible, stretchable material of any suitable well-known type. Hence, the strap is attached to the cleat body by means of a pair of channels 28 in which two portions of strap 26 are arranged. Each channel 28 includes access slots 30 formed in the lower or bottom surface of the cleat body 12 as seen in FIG. 2 thereof.

Body 12 also includes a fulcrum means which comprises a plurality of transverse rib members 32 arranged to engage the surface 34. In order to locate and hold cleat body 12 in its proper position with respect to the boot, the mounting strap is provided with a small front loop **26*a* and a rear loop 26*b*. Said forward small loop 26*a* is snapped over the front or toe member 33 of sole 20 of boot 14; and the larger rear loop is snapped over the extended edge of the heel member 35 of sole 20, as indicated in FIGS. 3 and 4.**

The larger rear loop 26b is provided with a pull tab 36 whereby the skier pulls said tab 36 to stretch strap 26 over the extended heel member 35.

Thus, it can be seen that the weight of the skier is placed on the heel member and the toe member is lifted above the ground level 34, as seen in FIG. 3. This arrangement allows the skier greater freedom of action whereby his knees no longer need to bend as the ankle portion is tilted rearwardly, allowing each leg to straighten. Accordingly, as seen in FIG. 4, the boot fulcrums forward over ribs 32 at which time the heel raises and the toe dips downwardly, allowing the skier freedom to walk.

Referring now to FIG. 5, there is shown an alternative use for the present device; that is, it can be arranged on the ankle member of the boot 15 and connected to the ski, so as to provide a means whereby the ski 40 can not be lost when it is accidentally separated from the ski boot, as shown in phantom lines.

The ski 40 is equipped with a ski-clamp means having a toe clamp 42 and a rear heel clamp 44. The large loop **26*b* is positioned over the ankle; and the small loop 26*a* is connected to restraining means 45 comprising snap clamp 46, which in turn is provided with a band 48. Band 48 is secured in any conventional manner to heel clamp 44. When the ski 40 separates from boot 40, it is restrained by the interconnecting of cleat 10 and the restraining means 45.**

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, expect as defined in the accompanying claims.

We claim:

1. A removable ski-boot cleat comprising:

a cleat body member with fulcrum means formed thereon;

a stretchable strap removably secured to said cleat-body member;

a pair of longitudinally disposed channels formed in said cleat-body member, wherein each channel includes corresponding slots through which said strap is passed to be held in said channels;

mounting means for stretching said strap to attach said cleat to said boot; and restraining means to removably attach the ski to said boot.

2. A ski-boot cleat as recited in claim 1, wherein said fulcrum means comprises a plurality of transverse rib members forming the bottom surface of said cleat-body member, whereby the cleat is positioned adjacent the forward portion of the ski boot to allow the boot to pivot thereon.

3. A ski-boot cleat as recited in claim 2, wherein said mounting means includes a pull tab secured to said strap whereby said strap can be stretched for mounting said cleat to said boot.

4. A ski-boot cleat s recited in claim 3, wherein said restraining means is removably attached between said strap and the ski when said strap is positioned about the ankle porton of said boot.

5. A ski-boot cleat as recited in claim 4, wherein said restraining means comprises:

a snap clamp having one end thereof connected to said strap; and a band member attached to said snap clamp.

* * * * *